US012565817B2

(12) United States Patent
Løland

(10) Patent No.: US 12,565,817 B2
(45) Date of Patent: Mar. 3, 2026

(54) SWIVEL AND CIRCULATION CONTROL VALVE TOOL

(71) Applicant: Archer Oiltools AS, Stavanger (NO)

(72) Inventor: Atle Løland, Bryne (NO)

(73) Assignee: ARCHER OILTOOLS AS, Stavanger (NO)

( * ) Notice: Subject to any disclaimer, the term of this patent is extended or adjusted under 35 U.S.C. 154(b) by 0 days.

(21) Appl. No.: 18/862,365

(22) PCT Filed: Apr. 28, 2023

(86) PCT No.: PCT/NO2023/050099
§ 371 (c)(1),
(2) Date: Nov. 1, 2024

(87) PCT Pub. No.: WO2023/214882
PCT Pub. Date: Nov. 9, 2023

(65) Prior Publication Data

US 2025/0297531 A1 Sep. 25, 2025

(30) Foreign Application Priority Data

May 2, 2022 (NO) ..... 20220497

(51) Int. Cl.
*E21B 21/10* (2006.01)
*E21B 17/05* (2006.01)
(Continued)

(52) U.S. Cl.
CPC ..... *E21B 21/10* (2013.01); *E21B 17/05* (2013.01); *E21B 17/07* (2013.01); *E21B 34/12* (2013.01)

(58) Field of Classification Search
CPC ..... E21B 21/10; E21B 17/05; E21B 17/07; E21B 34/12; E21B 21/08; E21B 21/00;
(Continued)

(56) References Cited

U.S. PATENT DOCUMENTS 3,405,764 A 10/1968 Nutter
4,452,313 A 6/1984 McMahan
(Continued)

FOREIGN PATENT DOCUMENTS

EP 0 594 393 A1 4/1994
WO WO 2014/009756 A2 1/2014

OTHER PUBLICATIONS

International Search Report (PCT/ISA/210) Issued in PCT/NO2023/050099, dated Jul. 21, 2023.
(Continued)

*Primary Examiner* — Brad Harcourt
(74) *Attorney, Agent, or Firm* — Birch, Stewart, Kolasch & Birch, LLP

(57) ABSTRACT

A swivel and circulation control valve tool includes an upper mandrel housing telescopingly connected on a telescope rod axially fixed in a lower mandrel housing, all having a through central bore. The telescope rod is provided with axially directed radial spline lugs arranged for, in a first, non-collapsed position, engaging with corresponding axially inwardly directed splines in the upper mandrel housing, for torque transfer to the lower mandrel housing, the spline lugs arranged for, in a second, collapsed position, releasing from the splines for allowing swiveling rotation of the upper mandrel housing about and relative to the telescoping rod and the lower mandrel housing, a lateral circulation port in the upper mandrel housing arranged for opening by aligning with a mandrel port in the telescope rod in the second, collapsed position, and for closing in the first, non-collapsed position, a releasable hydraulic lock arranged for locking the telescope rod in either the second, collapsed position, or the first, extended position. The hydraulic lock includes a piston arranged in an annular, liquid-filled cylinder chamber in the upper mandrel housing and fixed on the telescope rod, the piston having oppositely directed first and a second relief valves, each arranged for opening at predefined pressure differentials.

8 Claims, 5 Drawing Sheets

(51) Int. Cl.
*E21B 17/07* (2006.01)
*E21B 34/12* (2006.01)

(58) Field of Classification Search
CPC ..... E21B 23/004; E21B 23/04; E21B 34/08; E21B 34/14; E21B 37/00
See application file for complete search history.

(56) References Cited

U.S. PATENT DOCUMENTS

| | | | | |
|---|---|---|---|---|
| 4,657,082 | A | 4/1987 | Ringgenberg | |
| 5,383,520 | A | 1/1995 | Tucker et al. | |
| 6,109,354 | A | 8/2000 | Ringgenberg et al. | |
| 2007/0246217 | A1* | 10/2007 | Tulloch | E21B 21/103 166/311 |
| 2008/0000696 | A1* | 1/2008 | McGarian | E21B 17/05 175/256 |
| 2009/0260224 | A1 | 10/2009 | Wright et al. | |
| 2014/0014360 | A1 | 1/2014 | Wilson | |
| 2021/0324693 | A1* | 10/2021 | McGarian | E21B 29/08 |

OTHER PUBLICATIONS

Norwegian Search Report, issued in Priority Application No. 20220497, dated Dec. 2, 2022.
Written Opinion (PCT/ISA/237) issued in PCT/NO2023/050099, dated Jul. 21, 2023.

* cited by examiner

SWIVEL AND CIRCULATION CONTROL VALVE TOOL

FIELD OF THE INVENTION

The invention relates to a improved swivel and circulation control valve tool.

BACKGROUND OF THE INVENTION

Often during drilling and well operation there is a need for "boosting" the flow in annulus to maintain the velocity of the wellfluid when there is a change in the flow area. Circulation subs are often used for this.

One example of such a situation is when wellfluid is pumped down the string and out the bottom of a worksting inside the liner. The velocity of the wellfluid will drop when the fluid circulation out of the well reaches the larger diameter casing above the liner. Solids is lifted out of the well due to the velocity and viscosity of the wellfluid flowing up through the annulus. When the flow area of the annulus suddenly increases the velocity of the wellfluid will decrease. Then the solids might not follow the flow anymore and might start to accumulate in this region of the annulus.

The above mentioned example is only one situation out of many where it is desirable to maintain a more or less constant flow velocity in the annulus during circulation. Other uses for circulation subs can be to wash/clean a particular area in the well.

When cutting a tubular in the well using a rotating cutter it often limits what other tools can be placed in the workstring. Rotating with high rpm over some time might damage other tools and the casing wall. Casing cutters will usually require circulation, so a open through bore to the end of the workstring, ports below the cutter or a circulation sub below the cutter is required. These limitations can in some cases limit the number of sub-operations that can be performed on one trip into the well.

Another aspect limiting the number of sub-operations that can be carried by and operated in one workstring on the same trip into the well is the available mechanisms for activating tools downhole. The most common mechanisms for activating tools downhole is to rotate the workstring or increasing the flow and/or pressure inside the workstring. Another common mechanism is to land a ball in a ball seat and increasing the pressure above the ball to shear off shear screws holding the ball seat axially and thereby shifting the ball seat downwards. As the ball seat shifts downwards it mechanically shifts or activates the tool. To be able to activate the right tool at the right time there is often limitations to how many tools can be activated independently on each trip into the well.

Since it is common to shear screws or bolts as part of the activation of a downhole tool the tools are often limited to only be activated once and not being able to be deactivated and at least not activated and deactivated multiple times.

All the aspects mentioned above limits the number of tools on a workstring and the number of sub-operations that can be carried out on a single trip into the well.

Prior art includes:

EP0594393A1 discloses a apparatus for testing a subterranean formation. The apparatus comprises an internal-external differential pressure operated circulation tool comprising an elongate tubular housing having a passageway extending longitudinally therethrough. Said circulation tool further comprising a reverse circulation valve means for allowing fluid flow from the exterior of said circulation tool to said passageway of said circulation tool; an external pressure operated drill stem testing tool comprising an elongate tubular housing having a passageway extending longitudinally therethrough.

U.S. Pat. No. 4,657,082 A discloses a pressure operated circulation valve and method for using the same. A cylindrical housing has an open longitudinal passageway therethrough and a circulation port disposed through a wall thereof. A valve mandrel is slidably received in the housing and is moveable between a position in which fluid may be circulated only between the passageway and the exterior of the housing, a position in which fluid may be circulated only between the exterior of the housing and the passageway, and a position in which fluid may not be circulated in either direction. An annular piston is operatively connected to the valve mandrel and has a first side exposed to pressure exterior of the housing and a second side expose to pressure interior of the housing to permit movement of the valve mandrel to its various positions by application of pressure to the interior and exterior of the housing.

OBJECTS OF THE PRESENT INVENTION

An object of the invention is to provide a combined circulation and swivel sub.

Another object of the invention is provide more options for BHA design in well operations, in particular when a rotational casing cutter is to be used in combination with one or more plugs below the casing cutter.

SUMMARY OF THE INVENTION

The invention provides a improved swivel and circulation control valve tool. The tool comprises:

- an upper mandrel housing telescopingly connected on a telescope rod axially fixed in a lower mandrel housing, all having through central bore,
- said telescope rod provided with axially directed radial spline lugs arranged for in a first, non-collapsed position, engaging with corresponding axially inwardly directed splines in said upper mandrel housing, for torque transfer to said lower mandrel housing,
- said spline lugs arranged for, in a second, collapsed position, releasing from said splines for allowing swiveling rotation of the upper mandrel housing about and relative to the telescoping rod and said lower mandrel housing,
- a lateral circulation port in said upper mandrel housing arranged for opening by aligning with a mandrel port in said telescope rod in said second, collapsed position, and for closing in said first, non-collapsed position,
- a releasable hydraulic lock arranged for locking said telescope rod in either said second, collapsed position, or said first, extended position,
- said hydraulic lock comprising a piston arranged in an annular, liquid-filled cylinder chamber in said upper mandrel housing and fixed on said telescope rod, said piston having oppositely directed first and a second relief valves, each arranged for opening at predefined pressure differentials.

The hydraulic lock enables for an axial compressive force to open the lateral port, and to let the upper mandrel housing swivel, i.e. be rotatable relative to the below lower mandrel housing. The hydraulic lock enables for an axial tensile force to close the lateral port, and lock the upper mandrel housing to prevent swiveling.

The telescope rod can swivel relative to the upper mandrel housing when the telescope rod is in the second, collapsed position where the lateral circulation port and the mandrel port is axially aligned. An annulus or similar can be in place between the upper mandrel housing and the telescope rod to provide for fluid communication between the lateral circulation port and the mandrel port when they are axially aligned but not radially aligned due to swiveling.

The liquid in the liquid filled chamber can be a incompressible liquid. It should be incompressible to avoid the hydraulic lock to behave like an axial spring.

An advantage of this hydraulic lock is that it enables the circulation control valve tool to be shifted between positions and locked multiple times in both positions. The two positions being with ports closed, tool not swiveling and with ports open, tool swiveling, i.e. the first non-collapsed position and the second collapsed position.

It is a further advantage that the force needed to shift the tool from one position to the other can easily be setup before use. The tool can also be setup so that opening the valve (compressing the telescope) requires a higher force than closing the valve (extending the telescope) or the other way around. So, the tool can easily be adapted to the toolstring, the depth and the conditions in the well. Changing the required force can be done by changing to another relief valve or adjusting the relief valves in the hydraulic lock.

The above mentioned advantages provides an operator with more options when it comes to designing BHAs for the different runs during P&A and due to more options the number of runs can be reduced, saving rig time.

The telescope rod can comprise two parts, an upper part above said spline lugs comprising the mandrel port, and a lower part comprising the spline lugs, wherein the upper part and the lower part are connected via a rotational bearing arranged so that the lower part is allowed to rotate relative to the upper part when the tool is in the second, collapsed position.

One advantage of the two part telescope rod separated by a rotational bearing above the spline lugs is that the upper part will not rotate when the lower part is swiveling. Hence, less of the telescope rod an components related to the telescope rod will be affected by the rotation of the telescope rod, since some or all of them can be located above the rotational bearing. Meaning that mechanical wear and friction can be reduced.

The hydraulic lock can be arranged above the rotational bearing.

This has the advantage that seals and fragile parts in the hydraulic lock mechanism will not be affected by rotation of the telescope rod. Rotational seals can be avoided in the hydraulic lock. The friction due to swiveling will also be reduced again reducing mechanical wear.

The mandrel port can be arranged above the rotational bearing.

This has the advantage that there is no need for a annulus between the telescope rod and the upper mandrel housing, since the lateral circulation port and the mandrel port can be arranged to always radially align.

The swivel and circulation control valve tool can further comprise a thrust bearing arranged between the lower mandrel housing and the upper mandrel housing for reducing friction between the upper mandrel housing and the lower mandrel housing when the tool is in the second, collapsed position (i.e. when the tool is swiveling and the upper and lower mandrel housing is rotating relative to each other).

The thrust bearing can comprise a sleeve on the lower part of the mandrel telescope rod having a flange arranged between the lower mandrel housing and the upper mandrel housing.

The flange can be of softer metal or metal alloy, such as brass, copper or bronze.

The swivel and circulation control valve tool can further comprise a pressure alignment floating piston arranged in the annular cylinder chamber, wherein the floating piston separates a part of the annular cylinder chamber filled with the (clean) liquid and from another part of the annular cylinder chamber in communication with the fluid in a tool annulus.

The advantage of having such a floating piston is that the clean liquid in the annular, liquid-filled cylinder chamber can expand and contract due to changes in temperature and ambient pressure. At the same time dirty wellfluid is prevented from plugging/clogging the relief valves.

The lateral circulation port can be arranged for holding replaceable nozzles for allowing changing the flow area through the lateral circulation port.

The advantage of being able to change the flow area of the lateral circulation ports by replacing nozzles is that before use of the tool it is possible to setup how much of the flow will be passing out through the lateral circulation ports and how much is circulated further down the workstring/toolstring.

DESCRIPTION OF THE DIAGRAMS

Figure 3:
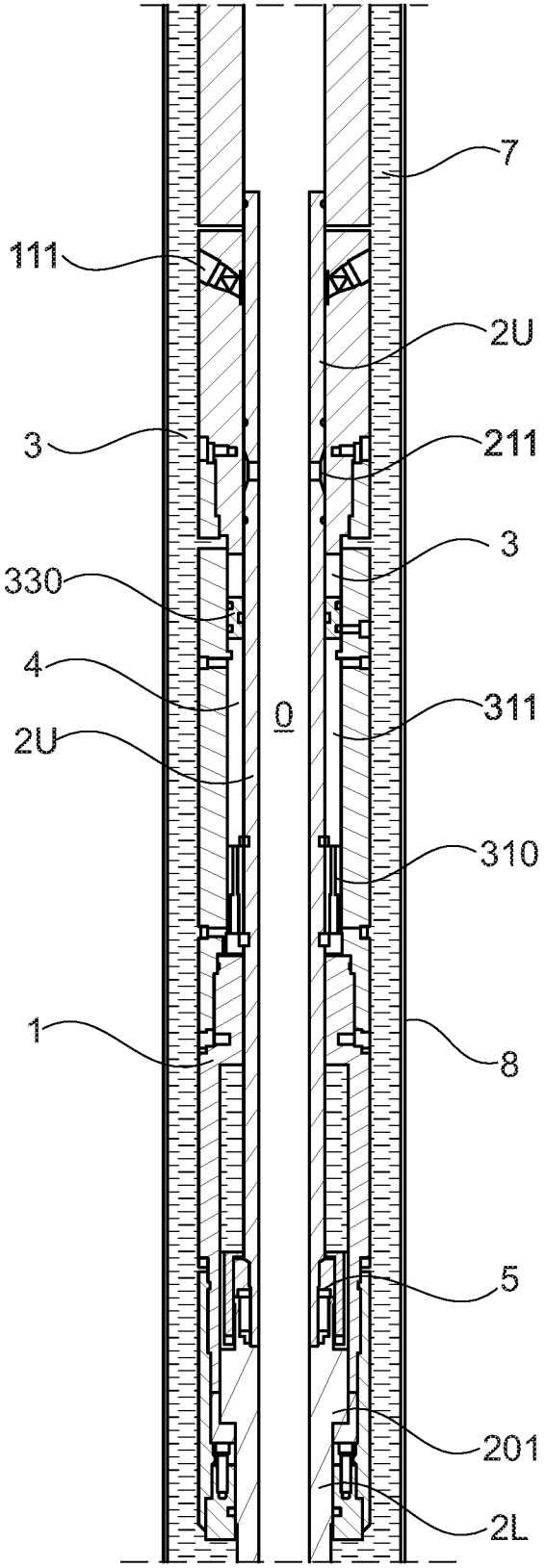

FIG. 3 shows part of the circulation control valve tool in a closer view. In this figure the tool is in the first, non-collapsed position. The figure is in section.

Figure 4:
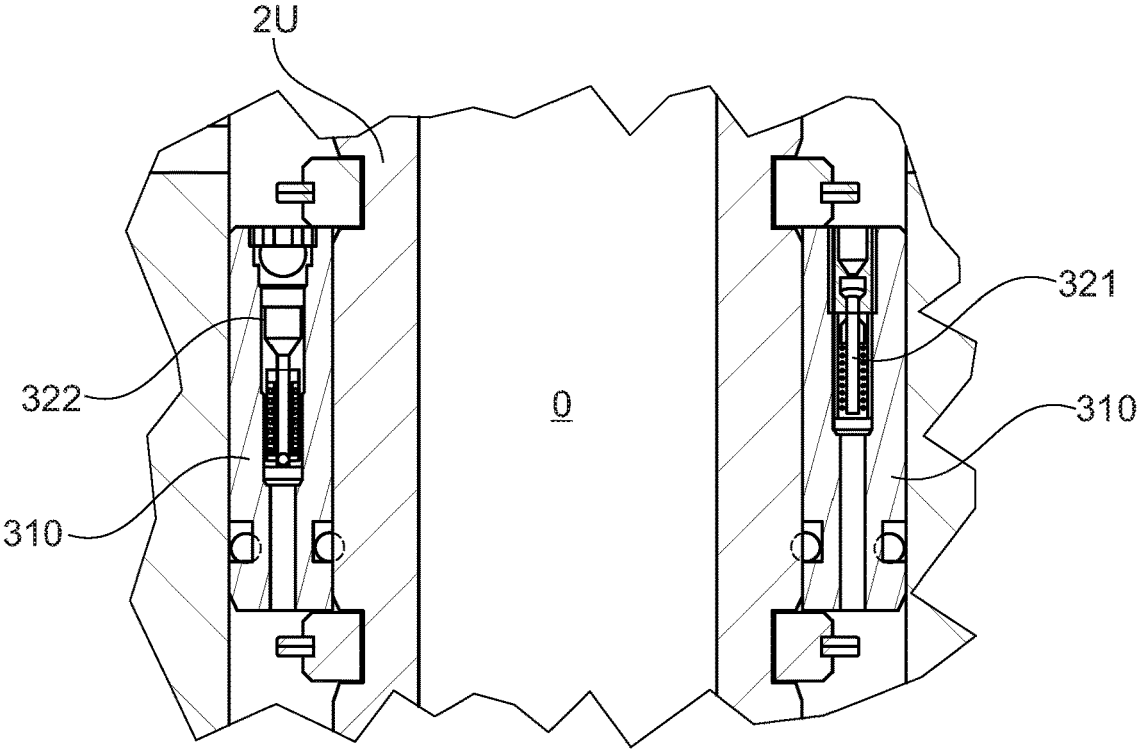

FIG. 4 shows the hydraulic lock mechanism in a closer view. The figure is in section.

Figure 5:
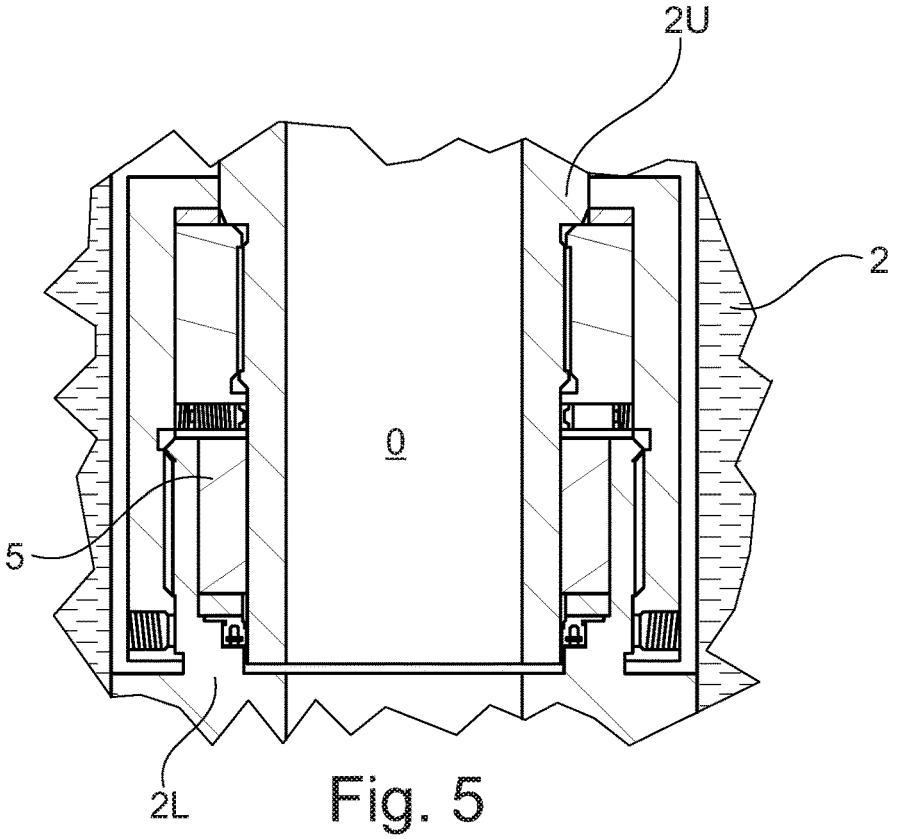

FIG. 5 shows the rotational bearing in a closer view. The figure is in section.

Figure 6:
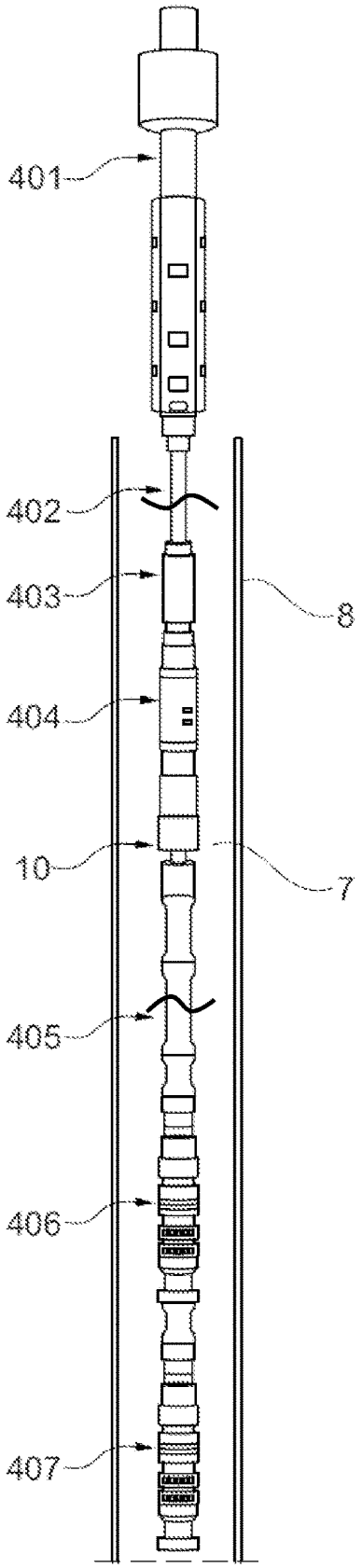

FIG. 6 shows a possible string and Bottom Hole Assembly (BHA) where the circulation control valve tool is included.

| Reference numbers | |
|---|---|
| 0 | Central bore |
| 1 | Upper mandrel housing |
| 2 | Mandrel telescope rod |
| 2U | Upper part of mandrel telescope rod |
| 2L | Lower part of mandrel telescope rod |
| 3 | Wellfluid |
| 4 | Clean liquid |
| 5 | Rotational Bearing |
| 6 | Thrust bearing |
| 7 | Annulus |
| 8 | Casing |
| 9 | Lower mandrel housing |
| 10 | Swivel and circulation control valve tool |
| 101 | Axially inwardly directed splines |
| 201 | Axially directed radial spline lugs |
| 111 | Lateral circulation port |
| 211 | Mandrel port |
| 301 | Hydraulic lock |
| 310 | Piston |

-continued

| Reference numbers | |
|---|---|
| 311 | Annular cylinder chamber |
| 321 | First relief valve |
| 322 | Second relief valve |
| 330 | Floating piston |
| 401 | Cement head |
| 402 | Drill pipe |
| 403 | Bumper sub |
| 404 | Rotating casing cutter |
| 405 | Drill pipe space out |
| 406 | Upper bridge plug |
| 407 | Lower bridge plug |

DESCRIPTION OF PREFERRED EMBODIMENTS OF THE INVENTION

In the following an embodiment of the invention will be described with reference to the drawings.

Terms like downwards/down/below and upwards/up/above is used in relation to the bottom of the well and the surface with the swivel and circulation control valve tool in its intended orientation in the well. Downwards/down/below being in the direction of the bottom of the well and upwards/up/above being in the direction towards the surface along the path of the well regardless of the inclination of the well.

Figure 1:
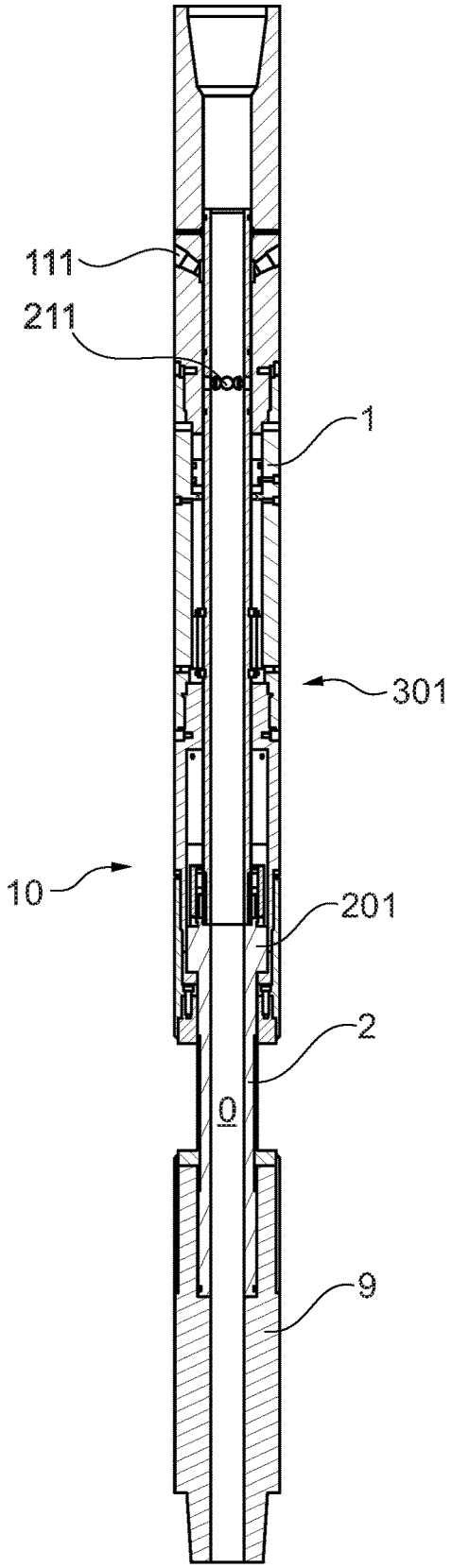
FIG. 1 shows the swivel and circulation control valve tool in the first, non-collapsed position, where the tool transfers torque and the lateral circulation ports are closed. The figure is in section.

FIG. 1 shows the swivel and circulation control valve tool 10 (hereafter the tool 10) in its first, non-collapsed position. In this position the mandrel port 211 is not aligned with the lateral circulation port 111, so there is no fluid communication between the central bore 0 and the annulus 7 surrounding the tool 10. The radial spline lugs 201 is engaged with the axially inwardly directed splines 101, so torque is transferred to the lower mandrel housing 9.

Figure 2:
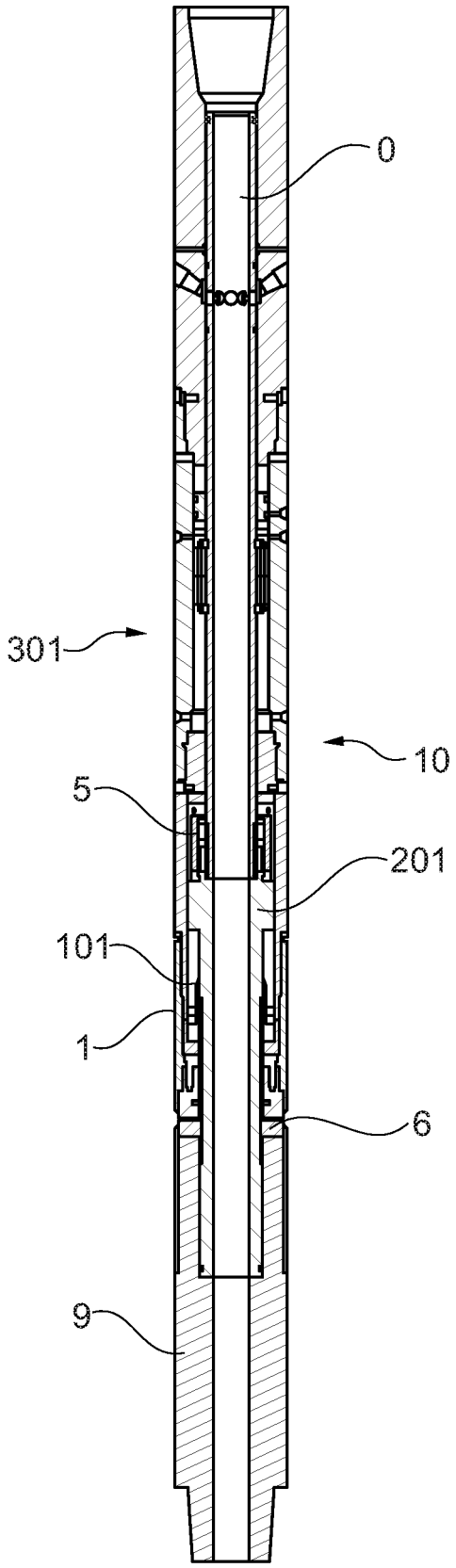
FIG. 2 shows the circulation control valve tool in the second, collapsed position, where the lateral circulation ports are open and the tool is acting like a swivel. The figure is in section.

In FIG. 2 the tool 10 is in the second collapsed position. In this position the mandrel port 211 is aligned with the lateral circulation port 111, so there is fluid communication between the central borer 0 and the annulus 7 surrounding the tool 10. The radial spline lugs 201 is not engaged with the axially inwardly directed splines 101, so torque is not transferred to the lower mandrel housing 9.

To shift the tool 10 from the first, non-collapsed position to the second collapsed position weight is set down on the tool 10 from above while the workstring or BHA below the tool is abutting something in the well. It can for instance be that a no-go sub in the string below the tool 10 is resting on the top of a liner in the well or the top of a cut-off casing, while the string below the no-go is extending into the liner or a cut-off casing.

The tool 10 can be shifted back from the second, collapsed position to the first non-collapsed position. This is done by pulling on the tool 10 via the workstring so that the mandrel telescope rod 2 is pulled out of the upper mandrel housing 1. To be able to do this there will have to be enough weight in the string below the tool 10. If the combined force of the weight and the friction below the tool 10 is not high enough the mandrel telescope rod 2 will not be pulled out.

The releasable hydraulic lock 301 is arranged to ensure that a certain force is needed to shift the tool 10 back and forth between the first and the second position. FIG. 3 provides a closer view of the releasable hydraulic lock 301.

The piston 310 is arranged in the liquid 4 filled cylinder chamber 311 between the upper mandrel housing 1 and the mandrel telescope rod 2. The piston 310 is axially fixed to the mandrel telescope rod 2. The two oppositely directed relief valves 321, 322 is arranged in the piston 310 and is configured to open at predefined pressure differentials, see FIG. 4. So, for the mandrel telescope rod 2 to move axially relative to the upper mandrel housing 1 liquid 4 has to pass through one of the relief valves 321, 322. Which valve 321, 322 fluid will pass through depends on the direction of movement of the mandrel telescope rod 2. Each of the valves 321, 322 can be arranged to open at different predefined pressure differentials. The hydraulic lock can be customized for the weight of the string below the tool 10 and other relevant variables.

In a embodiment the mandrel telescope rod 2 can have a upper part 2U comprising the mandrel port 211 and a lower part 2L comprising the spline lugs 201. The two parts is connected via the rotational bearing 5. The rotational bearing 5 is seen in a closer view in FIG. 5.

The hydraulic lock 301 can be arranged above the rotational bearing 5, so that rotational seals is avoided in hydraulic lock 301.

A thrust bearing 6 can also be arranged on the mandrel telescope rod 2 between the upper mandrel housing and the lower mandrel housing. The thrust bearing 6 can comprise a soft metal or metal alloy in the flange.

The annular cylinder chamber 311 can be in fluid communication with the annulus 7 surrounding the tool 10. So that the clean liquid 4 can expand and be compressed in response to changes in ambient pressure and temperature. To keep the clean liquid in the chamber 311 clean and separated from the dirty wellfluid a floating piston 330 can be arranged inside the annular cylinder chamber 311. This floating piston 330 separate a part of the annular cylinder chamber 311, that is in fluid communication with the surrounding annulus 7, from a part where the piston 310 is arranged. The floating piston 330 can freely move axially in the annular cylinder chamber 311 to compensate for volumetrically changes in the clean liquid 4 that is present in the part of the annular cylinder chamber 311 where the piston 310 is arranged.

The tool 10 has many possible applications. One possible application is in a string for setting two plugs 406, 407 and making a cut using a rotating casing cutter 404, see FIG. 6.

Using the swivel and circulation control valve tool 10 in such a string enables the operator to set and pressure test plugs 406, 407 both before and after operating the casing cutter 404. This is because the tool 10 can be switched between the two positions several times due to the releasable hydraulic lock. Plugs 406, 407 will usually require rotation and/or pressure to be set while the string below the cutter 404 should not rotate while cutting casing 8.

As an example the string in FIG. 6 can be run into the well with the tool 10 in the first position. When the lower bridge plug 407 is at the setting depth it can be set and tested. Then the tool 10 can be switched to the second position and the rotating casing cutter 404 can be operated. While making the cut the casing cutter 404 is rotating while the string below the tool 10 including the plug 406 is stationary. Circulation is going through the casing cutter 404 and out the lateral circulation port 111. After the rotational casing cutter 404 is operated the tool 10 can be switched to the first position to set the upper plug 406 using rotation and/or pressure.

The invention claimed is:

1. An improved swivel and circulation control valve tool, comprising:

an upper mandrel housing telescopingly connected on a telescope rod axially fixed in a lower mandrel housing, all the upper mandrel housing, the telescope rod and the lower mandrel housing having through central bore;

said telescope rod being provided with axially directed radial spline lugs arranged for, in a first, non-collapsed position, engaging with corresponding axially inwardly directed splines in said upper mandrel housing, for torque transfer to said lower mandrel housing;

said spline lugs being arranged for, in a second, collapsed position, releasing from said splines for allowing swiveling rotation of the upper mandrel housing about and relative to the telescope rod and said lower mandrel housing;

a lateral circulation port in said upper mandrel housing arranged for opening by aligning with a mandrel port in said telescope rod in said second, collapsed position, and for closing in said first, non-collapsed position;

a releasable hydraulic lock arranged for locking said telescope rod in either said second, collapsed position, or said first, extended position; and said hydraulic lock comprising a piston arranged in an annular, liquid filled cylinder chamber in said upper mandrel housing and fixed on said telescope rod, said piston having oppositely directed first and a second relief valves, each arranged for opening at predefined pressure differentials.

2. The swivel and circulation control valve tool according to claim 1, wherein the telescope rod comprises two parts, an upper part above said spline lugs comprising the mandrel port, and a lower part comprising the spline lugs, wherein the upper part and the lower part are connected via a rotational bearing arranged so that the lower part is allowed to rotate relative to the upper part when the tool is in the second, collapsed position.

3. The swivel and circulation control valve tool according to claim 2, wherein the hydraulic lock is arranged above the rotational bearing.

4. The swivel and circulation control valve tool according to claim 2, wherein the mandrel port is arranged above the rotational bearing.

5. The swivel and circulation control valve tool according to claim 1, further comprising a thrust bearing arranged between the lower mandrel housing and the upper mandrel housing for reducing friction between the upper mandrel housing and the lower mandrel housing when the tool is in the second, collapsed position.

6. The swivel and circulation control valve tool according to claim 5, wherein the thrust bearing comprises a sleeve on the lower part of the mandrel telescope rod having a flange arranged between the lower mandrel housing and the upper mandrel housing.

7. The swivel and circulation control valve tool according to claim 1, further comprising a pressure alignment floating piston arranged in the annular liquid-filled cylinder chamber, wherein the floating piston separates a part of the annular liquid-filled cylinder chamber filled with the liquid and from another part of the annular liquid-filled cylinder chamber in communication with the fluid in a tool annulus.

8. The swivel and circulation control valve tool according to claim 1, wherein the lateral circulation port is arranged for holding replaceable nozzles for allowing changing the flow area through the lateral circulation port.

* * * * *